United States Patent [19]

Queiser et al.

[11] Patent Number: 4,847,007

[45] Date of Patent: Jul. 11, 1989

[54] DEVICE FOR BONDING WASTES IN A BINDER

[75] Inventors: Horst Queiser, Bruchköbel; Siegfried Meininger, Altenstadt; Karl-Heinz Kleinschroth, Frankfurt am Main; Dietmar Bege, Erlangen, all of Fed. Rep. of Germany

[73] Assignee: Siemens Aktiengesellschaft, Berlin and Munich, Fed. Rep. of Germany

[21] Appl. No.: 16,497

[22] Filed: Feb. 17, 1987

Related U.S. Application Data

[63] Continuation of Ser. No. 763,827, Aug. 8, 1985, abandoned.

[30] Foreign Application Priority Data

Aug. 8, 1985 [DE] Fed. Rep. of Germany ..... 3429387

[51] Int. Cl.[4] ..... G21F 9/16; B01F 7/00; B01F 15/02; B01F 15/06

[52] U.S. Cl. ..... 252/628; 159/5; 159/11.1; 159/47.3; 159/DIG. 12; 366/75; 366/79; 366/97; 366/100; 366/144; 366/149; 366/156; 366/157; 366/249; 366/266; 366/282; 366/309; 366/310; 366/312; 366/319; 366/325; 425/208; 252/633

[58] Field of Search ..... 252/628, 626, 631, 633; 366/133, 134, 97, 138, 309, 310, 177, 182, 279, 285, 318, 4, 7, 8, 23, 24, 149, 159, 75, 76, 79, 100, 154, 155, 156, 157, 221, 249, 312, 325; 159/DIG. 12, 5, 11.1, 47.3; 425/208; 222/342, 412, 414

[56] References Cited

U.S. PATENT DOCUMENTS

| | | | |
|---|---|---|---|
| 3,292,911 | 12/1966 | Paul | 366/313 |
| 4,053,401 | 10/1977 | Fukushima et al. | 210/54 |
| 4,122,028 | 10/1978 | Iffland et al. | 252/631 |
| 4,194,842 | 3/1980 | Puthawala | 366/76 |
| 4,274,751 | 6/1981 | Rector et al. | 366/310 |
| 4,277,183 | 7/1981 | Shinriki | 366/310 |
| 4,280,922 | 7/1981 | Puthawala et al. | 252/628 |
| 4,289,407 | 9/1981 | Puthawala | 366/75 |
| 4,380,399 | 4/1983 | Godat et al. | 366/309 |
| 4,409,137 | 10/1983 | Mergan et al. | 252/632 |
| 4,436,655 | 3/1984 | Masotto et al. | 252/631 |
| 4,515,483 | 5/1985 | Muller et al. | 366/313 |
| 4,560,501 | 12/1985 | Minami et al. | 252/628 |

FOREIGN PATENT DOCUMENTS

| | | | |
|---|---|---|---|
| 2648263 | 9/1978 | Fed. Rep. of Germany | 252/628 |
| 3202518 | 8/1982 | Fed. Rep. of Germany . | |

*Primary Examiner*—Howard J. Locker

*Attorney, Agent, or Firm*—Herbert L. Lerner; Laurence A. Greenberg

[57] ABSTRACT

For bonding particularly radioactive wastes into a binder, a transporting and mixing device is used which transports the mixture to a storage tank prior to the hardening. The wastes are transported into the mixing zone by gravity and aided by the conveyor helix which also imparts additional wall cleaning action through the dry conveyor zone. A single or multi-component binder is concurrently transported in a direction lateral to the mixing tool to the mixing zone. The mixture is conducted in a straight-line extension of the transport and mixing direction to an outlet to which the storage tank is connected.

9 Claims, 2 Drawing Sheets

DEVICE FOR BONDING WASTES IN A BINDER

This application is a continuation, of application Ser. No. 763,827, filed Aug. 8, 1985 (now abandoned).

BACKGROUND OF THE INVENTION

1. Field of the Invention

The invention relates to a method for binding wastes, especially radioactive wastes into a binder to obtain a homogeneous, leach-resistant solid body of good compression strength, i.e. strong body resistant to pressure, by mixing the wastes with a binder by means of a screw conveyor and a mixer shaft, and hardening the binder, wherein the wastes are converted by a pretreatment, preferably a drying process, into the form of a flowable powder or granulate and wherein the mixture, prior to hardening, is transported into a storage tank. The method can also be used for treating toxic wastes generally. Further, the invention relates to apparatus particularly suitable for carrying out the method.

2. Description of the Prior Art

German Offenlegungsschrift DE-OS No. 3,202,518 describes cementing such wastes into barrels, in which three different screw conveyors with separate drive motors are combined into a glove box.

SUMMARY OF THE INVENTION

In contrast thereto, an object of the invention is to provide a method of the kind mentioned at the outset which employs simple means and is without limitation to cement as the binder.

Rather great versatility is desired with respect to the wastes to be bonded as well as, particularly, with respect to the binders.

With the foregoing and other objects in view, there is provided in accordance with the invention a method for bonding wastes, particularly radioactive wastes, into a binder for obtaining a homogeneous leach-resistant and strong, solid body, which comprises, pretreating the wastes to convert the wastes into the form of a flowable powder or granulate, introducing the flowable waste into a dry conveyor zone which contains a dry conveyor helix surrounded by a tubular housing which is positioned generally vertically, transporting the waste in the dry conveyor zone by the dry conveyor helix with the aid of gravity downwardly to an adjacent mixing zone also contained in the tubular housing, effecting cleaning of the housing interior wall in the dry conveyor zone by resting the conveyor helix resiliently against the inside wall of the housing to carry out a cleaning rubbing action during rotation of the helix, concurrently transporting a binder laterally to the mixing and transport direction, to the mixing zone containing a mixing fork connected to the conveyor helix, mixing the waste and the binder in the mixing zone, conducting the mixture from the mixing zone to a discharge zone which is a straight extension of the mixing zone and contains a viscous-matter pump, and pumping the mixture through a discharge outlet of the discharge zone to a storage vessel.

In accordance with the invention, there is provided an apparatus for bonding wastes, particularly radioactive wastes, into a binder for obtaining a homogeneous leach-resistant and strong solid body, comprising: a tubular housing in which a dry conveyor helix, a mixing fork and a viscous-matter pump are arranged in a straight line and are connected to a common drive motor with the helix disposed in the top part of the housing and the pump disposed in the bottom part of the housing, a venting line is connected to the top side of the housing, an opening in the housing surrounding the helix is provided for introducing waste feed, a line for a liquid binder leads to an opening in the housing surrounding the mixing fork, and discharge means through which the mixture of waste and binder discharge from the viscous-matter pump.

Other features which are considered as characteristic for the invention are set forth in the appended claims.

Although the invention is illustrated and described herein as embodied in a method and apparatus for bonding especially radioactive wastes in a binder, it is nevertheless not intended to be limited to the details shown, since various modifications may be made therein without departing from the spirit of the invention and within the scope and range of equivalents of the claims.

BRIEF DESCRIPTION OF THE DRAWINGS

The invention, however, together with additional objects and advantages thereof will be best understood from the following description when read in connection with the accompanying drawings, in which.

DESCRIPTION OF THE PREFERRED EMBODIMENTS

Figure 1:
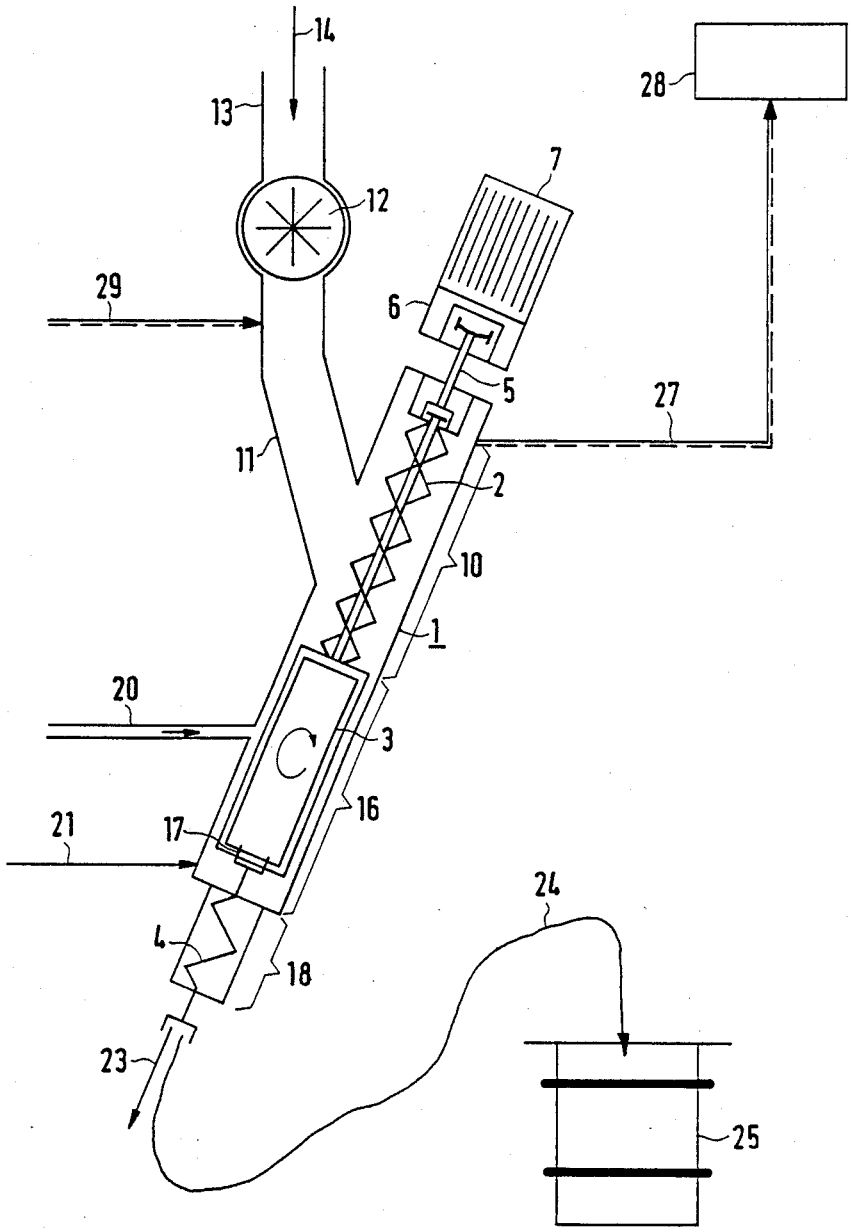
FIG. 1 diagrammatically illustrates apparatus for bonding wastes into a binder in accordance with the invention, having a tubular housing in which a dry conveyor helix, a mixing fork and a viscous-matter pump are arranged in a straight line and are connected to a common drive motor. A waste feed line opens to the conveyor zone of the helix. A line for feeding liquid binder leads to the mixing fork. A line for feeding a second component of a two-component binder leading to the discharge from the mixing fork. A venting line is connected to the top side of the housing.

According to the invention, the wastes are transported by a conveyor screw designed as a dry conveyor helix and by gravity into a mixing zone. In the process, the dry conveyor helix effectuates cleaning of the screw housing surrounding the conveyor screw. Simultaneously, the binder is transported in the direction lateral to the mixing and transport direction to a mixing zone and is treated there by a mixing shaft designed as a mixing fork. The treated mixture is continuously conducted in a straight extension of the mixing zone by a viscous-matter pump to a discharge to which the storage tank is connected.

With the invention, there is practically only a single conveyor and mixing screw. However, it may be composed of several movable members. This is of advantage if parts subject to wear are to be replaced or are to be adapted to different binders. The new method is particularly well suited for using different binders, as will be explained in detail later on in conjunction with the description of embodiment examples. Pretreatment of the wastes without binder can be effected, for instance, the input, that is, addition of additives to the wastes occurs after the pretreatment of the wastes.

The binder can be preheated to obtain a desired liquidity of the binder. This is important for working with thermoplastic binders such as bitumen. The heating-up span in the mixing process proper can be correspondingly small. With two- or multi-component binders, for instance, plastics such as polystyrene with hardeners such as divinylbenzene, one of the components can first be incorporated in the wastes, i.e. can be premixed with the wastes.

The new method is best carried out by having the wastes transported, mixed and discharged from top to bottom in an at least largely vertical direction which means in a direction which is less than 45°, preferably less than 30° from the vertical. This procedure aids the conveyor action by the force of gravity, and also results in gases and vapors being given off in a direction opposed to the force of gravity. In the process, gas such as air or other suitable gas is introduced into the housing to dilute gases therein which may contain adhesive vapors. This air also flushes out the undesirable adhesive vapors and prevents undesirable deposition of such vapors in the interior of the housing.

Apparatus for carrying out the method according to the invention has demonstrated its practical utility. Such apparatus involves a screw mixer with a tubular housing in which a dry conveyor helix, a mixing fork and a viscous-matter pump are arranged in a straight line and are connected to a common drive motor. A venting line may be connected to the top side of the housing. Like the housing and feed lines leading to the housing, the venting line may be heated in the region of the continuous-flow mixer. In addition, thermal insulation which covers the housing including a feed line for the wastes is advantageous. The above-mentioned heating means for heating the housing and connecting lines can be detachably attached, to make the housing readily accessible for inspection.

A line for feeding a liquid binder leads to a region of the mixing fork. If a two-component binder is involved, a feed line for the second component can be provided on the discharge side at the end of the mixing fork. Transport of the mixture of waste and binder by the viscous-matter pump then causes this second component to be distributed throughout the waste mixture. With components which can be distributed easily, it may in some circumstances be sufficient to place such components in the storage tank to thereby prevent premature hardening of the other binder component.

An important feature of a further embodiment of the apparatus resides in coating the inside of the housing and/or the dry conveyor helix and/or the viscous-matter pump and/or the mixing fork with a plastic as an antiadhesion agent, especially of the polytetrafluoroethylene type. It was found that such an antiadhesion agent reduced the contamination by encrustation, because the wastes including the binders can easily be separated from the machine parts. At the end of a run, flushing the interior of the housing with a fluid, usually a gas will be found satisfactory, will aid in detaching the encrustations, with the unattached contaminants carried out of the housing by the flushing fluid. Wear can further be reduced quite substantially. These advantages can also be achieved in other apparatus for waste treatment, especially in practically all screw-type machines.

To explain the invention in greater detail, two embodiment examples will be described, referring to the attached drawing. They show, schematically simplified, apparatus specially adapted therefor.

In FIG. 1 the apparatus comprises a tubular housing 1 which has an inside diameter of, for instance, 130 mm. The housing encloses the movable parts 2, 3 and 4 which are arranged on a common, largely vertical axis and are driven by an electric motor 7 via a coupling 5 and a reduction gear 6.

The parts 2, 3 and 4 determine the individual work zones in the housing 1. The helical screw 2 defines a dry conveyor zone 10. Contrary to the graphic presentation, the conveyor helix 2 rests resiliently against the inside wall of the housing so that a cleaning rubbing action is carried out during the rotation.

A vertical gravity pipe 11 which is connected to an input line 14 via a dosing device 12 leads into the zone 10. As indicated by the arrow 14, flowable radioactive waste, for instance, in the form of powder, granulate or the like, enters through the dosing device 14 vertically from the top. An example of flowable waste are dried resin balls from ion exchanger filters. The mixing device 3 which is designed as a fork and the length of which determines the mixing zone 16 in the housing is directly connected to the conveyor helix 2. The fork 3 may be closed at its lower end by a bracket 17 to provide a means for coupling the helix 4 serving as a viscous-matter pump. The latter determines the discharge zone 18 which may have a somewhat smaller housing diameter.

A line 20 which opens up laterally in housing 1 and through which liquid resin enters as component 1 of a two-component binder is connected to the mixing zone 16. Polystyrene is an example of such a component. Divinylbenzene is added as component 2 at the end of the mixing zone 16 as seen in the flow direction and shown by the arrow 21. Component 2 is mixed sufficiently with the mixture of wastes and the component 1, prepared in the mixing zone 16 by the motion of the viscous-matter pump 4 alone. In the case of three- and multi-component plastics, the liquid components are simultaneously fed into the mixing zone through sequential feed openings. If the hardening time is short then, to avoid premature hardening, the hardener should be added at or near the entrance to the storage tank (for instance, at the tap opening to the tank).

The mixture from the discharge zone 18 is transported either, as shown by the arrow 23, directly into a barrel not shown, or indirectly via a hose 24, by means of which several barrels 25 can optionally be serviced sequentially without the need of moving the barrels. This arrangement can also be utilized as a product switching means, whereby mixtures of different wastes and/or binders can be conducted into different storage tanks.

A venting line 27 which leads to an exhaust air system 28 is arranged at the upper end of the dry conveyor zone 10. The exhaust air system can be the exhaust gas system of a nuclear power station enabling secure further processing of the exhaust air without further cost. The line 27 can also be connected to the building venting system providing however that the exhaust air does not contain impermissible amounts of radioactivity. The venting can be assisted by a fan, not shown, which maintains underpressure in the housing 1.

An air supply can also be provided as shown by the arrow 29 for flushing the housing 1. In the embodiment example according to FIG. 1, the air is supplied in the region of the gravity tube 11, thereby preventing dust or waste material from caking and closing up the gravity tube 11.

Figure 2:
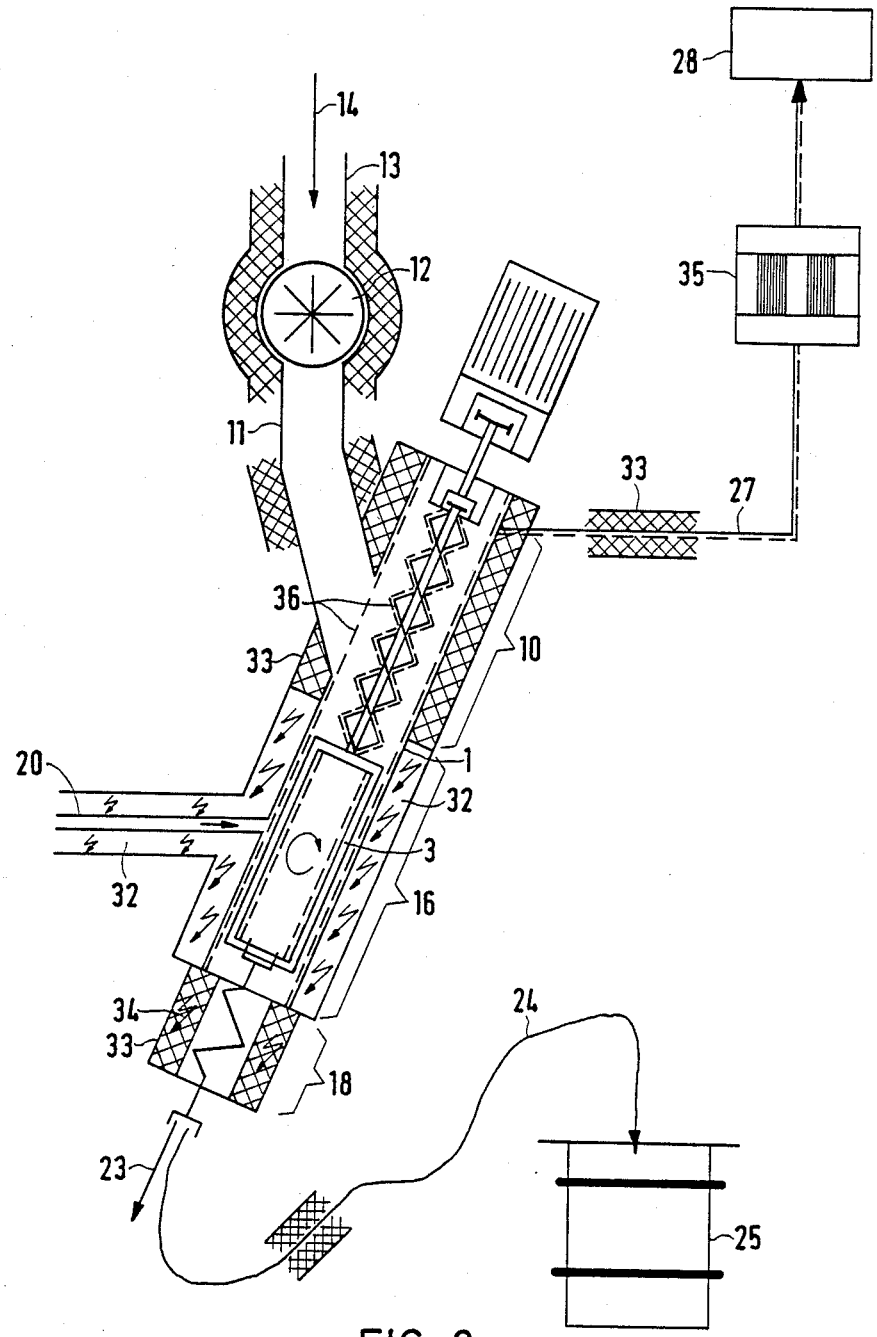
FIG. 2 is generally similar in structure to FIG. 1 but differs in that the housing and connecting lines are equipped with heating means particularly a heating jacket, and insulation, for maintaining bitumen which is used as a binder in liquid form until adequately mixed with the wastes.

In the embodiment example according to FIG. 2, bitumen is to be processed as the binder. It is fed-in through the line 20. The latter, however, as well as the mixing zone 16 is provided with a heating jacket 32 which optionally may be removable. Heating of the line and mixing zone may be accomplished, for instance, by electrical resistance conductors with heat-resistant insulation which are wound on the tubular housing 1 and the wall of the line 20. Alternatively, the heating jacket can be a tubular housing which can be heated, for instance, by steam heating.

The further parts of the housing 1, particularly the dry conveyor screw 10 and the discharge zone 18, are surrounded by thermal insulation 33 which is composed of individual, detachably fastened half-shells. The thermal insulation also extends over the gravity tube 11, the dosing device 12 and the inlet 13. In the heat insulation 33 of the discharge zone 18 and the hose 24 connected thereto, heating elements can be provided as indicated by the arrows 34. Thereby, the bitumen which is introduced into the mixing zone 16 and is preheated outside the housing zone, can be kept liquid until, mixed with the waste, it is transported either directly to a barrel, not depicted in detail, as shown by the arrow 23, or has passed through a hose 24, by means of which several barrels 25 can optionally be serviced consecutively without the need of moving the barrels. Furthermore, the barrels can also be filled alternatingly via a product switch.

The venting line 27 is likewise provided here with thermal insulation 33. The latter extends, for instance, up to an oil filter 35 which is provided ahead of the exhaust air system in order to prevent oil vapor from entering the exhaust air system.

As indicated in FIG. 2 by dashed lines, the device on the inside of housing 1, the dry conveyor helix 2 and the mixing fork are advantageously provided with an antiadhesion layer 36 in the form of a coating with polytetrafluoroethylene. The coating can be applied, for instance, by an immersion process for the mixing fork 3 and by a spraying process for the housing 1. It has a thickness of 0.3 to 1 mm. Abrasion which may possibly increase in the discharge direction can be taken into account in determining the thickness. The housing 1 can consist completely of a plastic suitable as an antiadhesion agent in the region of the discharge zone 18 and of the viscous-matter pump 4. This reduces the wear of the device considerably. In addition, disturbing soiling is prevented and cleaning the device is facilitated.

There is claimed:

1. Device for bonding, wastes, into a binder for obtaining a homogeneous, leaching-resistant and pressure-resistant solid body, comprising a screw conveyor mixer with housing in which waste materials are transported from the top toward the bottom generally in a vertical direction, with at least one of (a) the inner side of the housing and (b) the screw conveyor mixer coated with a synthetic material, wherein in the housing a dry transport screw, a mixing fork and a viscous material pump are arranged in straight succession, and connected by a common drive motor, wherein at the top side of the housing a venting line is connected, wherein a line for a liquid binding agent leads into the region of the mixing fork and wherein the screw conveyor mixer is in elastically yielding contact with the inner side of the housing and is formed with transport spirals for producing a continuous friction effect which cleans the device to avoid baking of the waste materials.

2. Device according to claim 1, wherein a feedline is provided at the output side end of the mixing fork for a second component of a two-component binder.

3. Device according to claim 1, wherein the viscous material pump is provided with a product distribution device by which the mixture can be distributed to different storage containers.

4. Device for bonding, wastes into a binder for obtaining a homogeneous, leaching-resistant and pressure-resistant solid body, comprising a tube-shaped housing surrounding a conveyor screw for moving wastes in the housing, wherein at least one of a) the inner side of the housing and (b) the conveyor screw is coated with a synthetic material as an antiadhesion agent, wherein the conveyor screw is in elastically yielding contact with the inner side of the housing and is formed with transport spirals for producing a continuous friction effect which cleans the device to avoid baking of the waste materials.

5. Device according to claim 4, wherein the coating contains a polytetrafluoroethylene base.

6. Device according to claim 4, wherein the conveyor screw is connected with a mixing fork and a viscous material pump which is also coated with the synthetic material.

7. Device according to claim 6, wherein the housing of the viscous material pump consists of a synthetic material suitable as the antiadhesion agent.

8. Device according to claim 1, wherein the wastes are radioactive.

9. Device according to claim 4, wherein the wastes are radioactive.

* * * * *

UNITED STATES PATENT OFFICE

CERTIFICATE OF CORRECTION

PATENT NO. 4,847,007

DATED Jul. 11, 1989

INVENTOR(S) Queiser et al

It is certified that error appears in the above-identified patent and that said Letters Patent is hereby corrected as shown below:

Title page, item [30], "Aug. 8, 1985 (DE)"

should read:

- - Aug. 9, 1984 (DE) - -

Signed and Sealed this

Seventh Day of August, 1990

*Attest:*

HARRY F. MANBECK, JR.

*Attesting Officer*

*Commissioner of Patents and Trademarks*